US007339571B2

(12) United States Patent
Yamamoto et al.

(10) Patent No.: US 7,339,571 B2
(45) Date of Patent: Mar. 4, 2008

(54) LIQUID CRYSTAL DISPLAY DEVICE

(75) Inventors: Akira Yamamoto, Kawasaki (JP); Kazuhiro Takahara, Kawasaki (JP); Hiroshi Murakami, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/287,304

(22) Filed: Apr. 7, 1999

(65) Prior Publication Data

US 2002/0030648 A1 Mar. 14, 2002

(30) Foreign Application Priority Data

May 19, 1998 (JP) ..... 10-137247

(51) Int. Cl.
*G09G 3/36* (2006.01)

(52) U.S. Cl. ..... 345/100

(58) Field of Classification Search ..... 345/87–89, 345/91, 92, 94, 98, 99, 100, 103
See application file for complete search history.

(56) References Cited

U.S. PATENT DOCUMENTS 5,574,475 A * 11/1996 Callahan, Jr. et al. ..... 345/100
5,598,178 A * 1/1997 Kawamori ..... 345/93
5,654,735 A * 8/1997 Nakajima ..... 345/99
5,739,805 A * 4/1998 Dingwall ..... 345/100
5,745,093 A * 4/1998 Tsuzuki et al. ..... 345/103
5,856,816 A * 1/1999 Youn ..... 345/98
5,914,699 A * 6/1999 Imamura ..... 345/99
5,929,832 A 7/1999 Furukawa et al. ..... 345/98
5,977,944 A * 11/1999 Kubota et al. ..... 345/100
6,014,193 A 1/2000 Taira et al. ..... 349/73
6,023,260 A 2/2000 Higashi ..... 345/100
6,040,812 A 3/2000 Lewis ..... 345/89
6,067,066 A * 5/2000 Kubota et al. ..... 345/98
6,130,657 A * 10/2000 Kurokawa et al. ..... 345/100
6,362,804 B1 * 3/2002 Park et al. ..... 345/99

FOREIGN PATENT DOCUMENTS

| | | |
|---|---|---|
| CN | 319862 | 11/1997 |
| JP | 7-199874 A | 8/1995 |
| JP | 08-043852 | 2/1996 |
| JP | 10-307567 | 11/1998 |

* cited by examiner

*Primary Examiner*—Jeff Piziali
(74) *Attorney, Agent, or Firm*—Greer, Burns & Crain, Ltd

(57) ABSTRACT

A liquid crystal display device includes a liquid crystal display panel, a data driver connected to the liquid crystal display panel, and a gate driver connected to the liquid crystal display panel. The data driver is divided into a plurality of blocks, which simultaneously supply the liquid crystal display panel with display signals respectively supplied thereto.

21 Claims, 20 Drawing Sheets

LIQUID CRYSTAL DISPLAY DEVICE

BACKGROUND OF THE INVENTION

1. Field of the Invention

The present invention generally relates to a liquid crystal display device, and more particularly to a liquid crystal display device having a panel of a peripheral circuit integrated type on which a peripheral circuit and a liquid crystal display part are integrally formed on a base.

2. Description of the Related Art

A liquid crystal display panel is as small as a few inches and has relatively small delay of time due to the resistances of interconnection lines.

FIG. 1 shows a conventional liquid crystal display device, which includes a substrate 10, a data driver 12, a gate driver 14 and a liquid crystal panel 16.

The data driver 12 includes a shift register 18, display signal lines 30, a plurality of 24-bit data buses (eight sets of R, G and B lines) 22, a level shifter 24, and an analog switch unit 28. A group 26 of control signals are applied to the level shifter 24. More particularly, the control signals are a start signal DS1 and two clock signals DCLK1 and DCLK2 externally applied to the shift register 18 via the level shifter 24. In response to the start signal DS1, the shift register 18 starts to operate, and opens or close analog switches of the analog switch unit 28 by using the clock signals DCLK1 and DCLK2. Display signals R1, G1, B1, . . . , R24, G24 and B24 transferred over the 24 display signal lines 30 are applied to the liquid crystal panel 16 via the data buses 22.

The gate driver 14 is made up of a shift register 32, a buffer 34 and a level shifter 36.

The shift register 32 receives a group 40 of control signals, which are a start signal GS1, and two clock signals GCLK1 and GCLK2 externally applied to the shift register 32 via the level shifter 36. In response to the start signal GS1, the shift register 32 starts to operate, and output drive signals which serially specify data take-in positions by using the clock signals GCLK1 and GCLK2. The drive signals are then applied to the liquid crystal panel 16 via the buffer 34.

As shown in FIG. 2, the liquid crystal panel 16 is scanned from the left-hand side to the right-hand side. More particularly, the analog switches of the unit 28 connected to the leftmost 24-bit data bus 22 are closed, and the display data R1-B8 are written onto the leftmost 24-bit data bus 22. Then, the neighboring 24-bit data bus 22 is selected by closing the associated analog switches of the unit 28, and is supplied to the display data. The above operation is repeatedly carried out 100 times.

When the display data amounting to the first scanning line of the panel 16 extending from the shift register 32 has been sent thereto, the above display data is written onto the first scanning line. Thereafter, the display data is written into the 2400 data bus lines as described above, and the shift register 32 drives the second scanning line. In the above manner, the display data is written into the whole panel 16.

The display data are supplied to the 24-bit data buses 22 one by one at the different timings. This method is called dot-sequential driving method. When the number of pixels of the panel 16 is equal to 800×RGB×60 dots, the frequency of the control signals 26 is equal to 40 MHz. By dividing the frequency of 40 MHz by the number of 24-bit data buses 22, each of the 24-bit data buses 22 is assigned 5 MHz (200 ns). It is thus required to complete the writing of display data onto the 24 bus lines (24 bits equal to 8×RGB) within only 200 ns. Generally, when a compact panel has a size of a few inches and each line of the 24-bit data buses 22 is made of aluminum, the bus line has a resistance of a few kilo-ohms and a capacitance of 10 pF. If each line of the 24-bit data buses 22 has a resistance of 3 kΩ, the time constant of the bus lines is equal to 3 kΩ×10 pF=30 ns. Hence, if it is required to provide a charging time as long as five times the time constant of the bus 20 in order to settle the 24-bit data bus 22 with a sufficient margin, it is enough to write the display data onto the 24-bit data bus 22 for about 150 ns. Hence, there is no problem.

However, when the panel 16 has a large size of 10 inches or more, each line of the 24-bit data buses 22 has a resistance of 10 kΩ or more. Additionally, the resistance of the display signal lines 30 cannot be neglected. The resistance of the display signal lines 30 can be reduced if an increased number of lines 30 is used, as shown in FIG. 3. The structure shown in FIG. 3 employs 300 display signal lines to which display signals D1-D300 are respectively applied. The display signal lines 42 can be driven by a general—purpose data driver IC marketed. When a increased number of display signal lines is used, the display data can be written onto the data buses 22 for a longer time. Hence, the width of each of the display signal lines 42 can be reduced. However, the total width of the display signal lines 42 is approximately equal to 6.0 mm. This increases the size of the peripheral circuits with regard to the panel 16.

It may be possible to use an intermediate number of display signal lines (for example, 100 lines) in order to reduce the size of the peripheral circuits formed on the substrate 10. The intermediate number of display signal lines is driven by the general-purpose data driver IC. As the number of display signal line is reduced, the available write time is reduced. Hence, it is required to increase the width of each of the display signal lines. However, as the width of each of the display signal lines is increased, the cross coupling capacitance formed between each display signal line and the associated data bus line is increased. For example, if each of the display signal lines is 90 μm wide and each of the data bus lines 22 is 5 μm wide, the cross coupling capacitance is as large as 150 pF. Since the general-purpose data driver IC has a driving capability of approximately tens of pF, it cannot drive the 100 display signal lines.

It can be seen from the above that it is required to reduce the cross coupling capacitance and the area on the substrate 10 occupied by the display signal lines. Unless the above requirements are satisfied, the liquid crystal display device of a large size does not have satisfactory performance.

SUMMARY OF THE INVENTION

It is a general object of the present invention to provide a liquid crystal display device in which the above disadvantages are eliminated.

The above object of the present invention is achieved by a liquid crystal display device comprising: a liquid crystal display panel; a data driver connected to the liquid crystal display panel; and a gate driver connected to the liquid crystal display panel. The data driver is divided into a plurality of blocks, which simultaneously supply the liquid crystal display panel with display signals respectively supplied thereto. Hence, each of the blocks has a reduced number of display signal lines, which reduces an area for arranging the display signal lines. Hence, the cross-coupling capacitance can be reduced.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1:
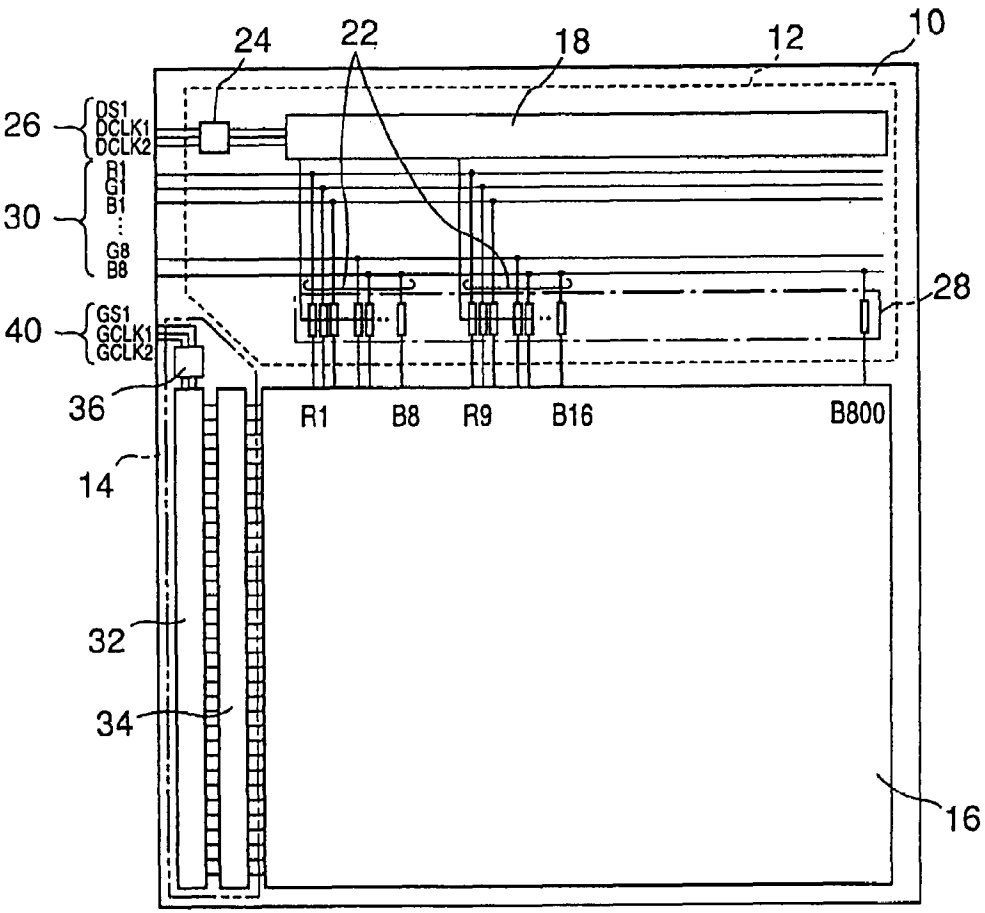
FIG. 1 (PRIOR ART)
FIG. 1 is a block diagram of a conventional liquid crystal display device of a dot sequential type.
Figure 2:
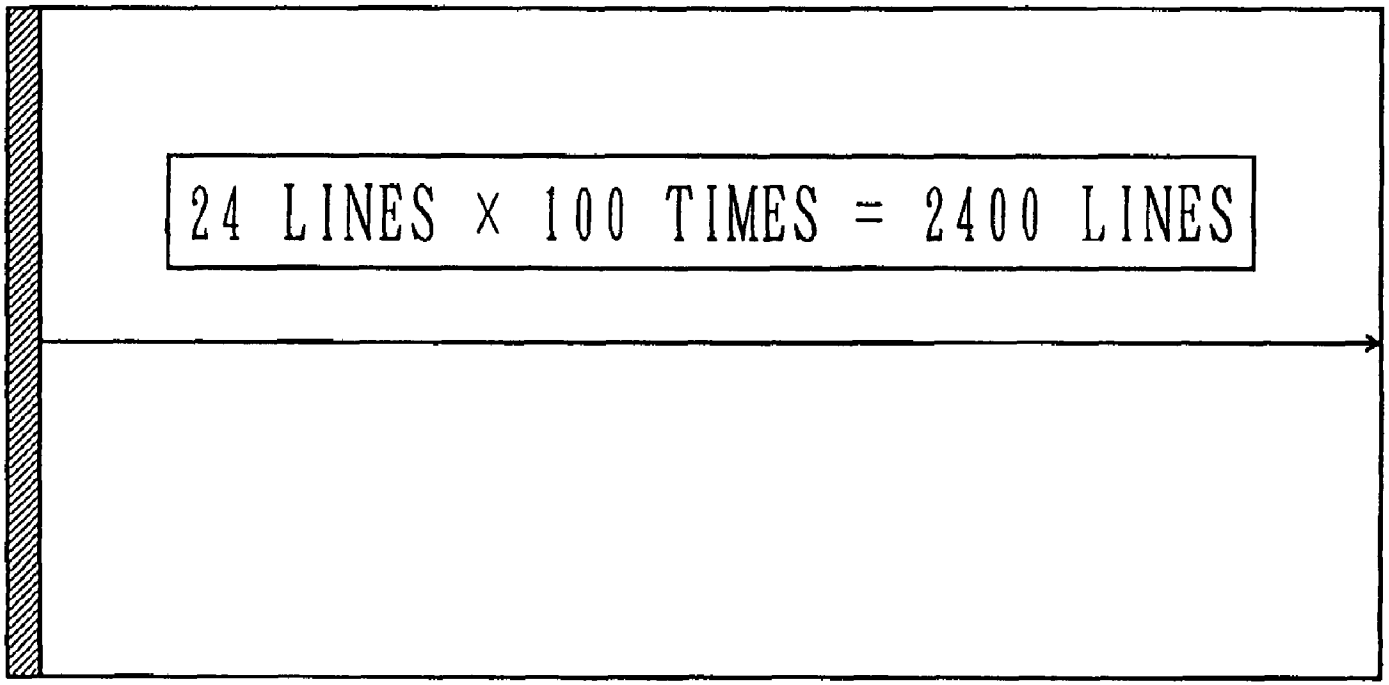
FIG. 2 (PRIOR ART)
FIG. 2 shows a method of writing display signals in the conventional device shown in FIG. 1.
Figure 3:
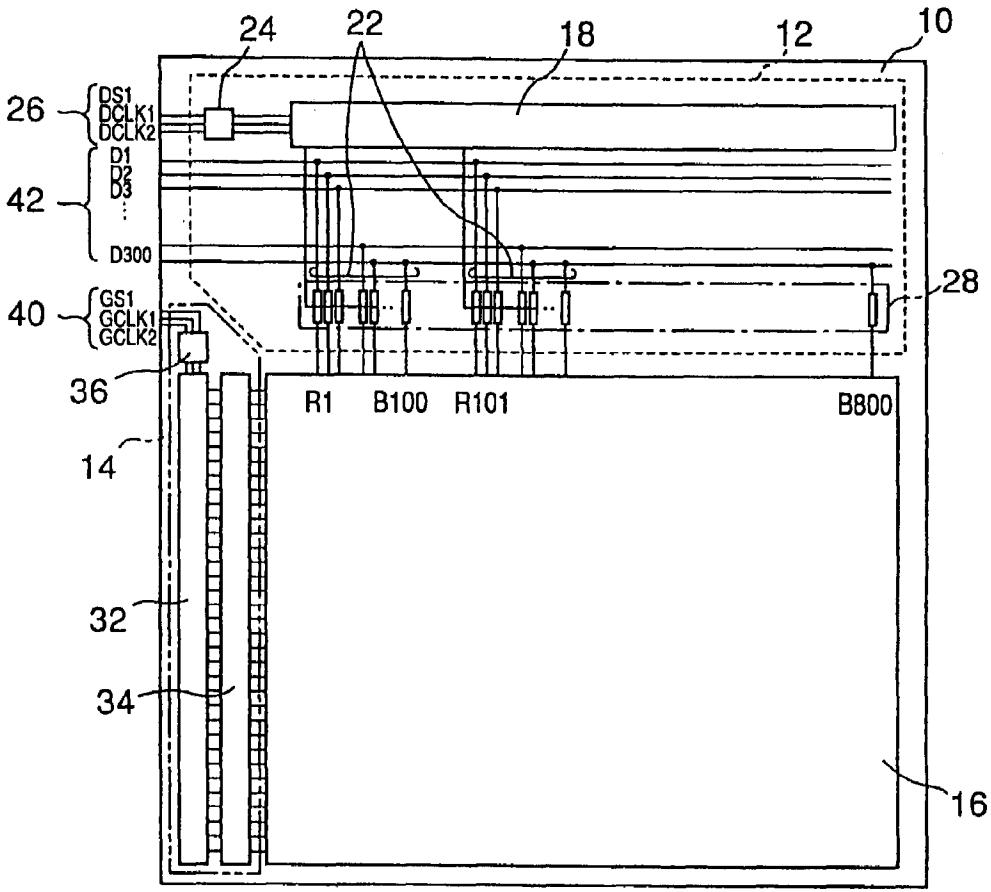
FIG. 3 (PRIOR ART)
FIG. 3 is a block diagram of a variation of the device shown in FIG. 1.
Figure 4:
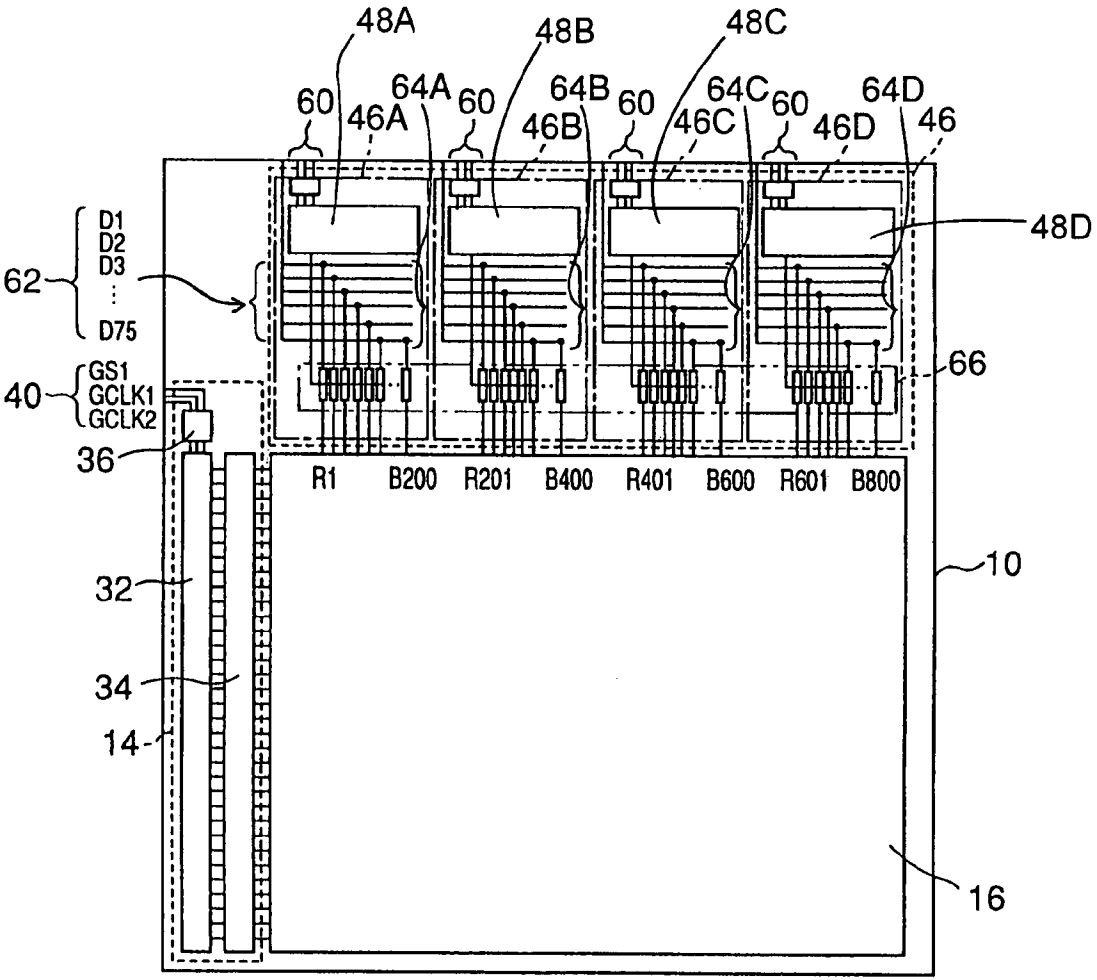
FIG. 4 is a block diagram of an outline of a liquid crystal display device according to a first embodiment of the present invention.

FIG. 4 is a block diagram of an outline of a liquid crystal display device according to the present invention. In FIG. 4, parts that are the same as those shown in the previously described figures are given the same reference numbers.

In the structure shown in FIG. 4, the data driver 12 is divided into four blocks 46A, 46B, 46C and 46D, which respectively have 75 display signal lines 64A, 64B, 64C and 64D, and shift registers 48A, 48B, 48C and 48D, and analog switch units 66, which components are integrally formed on the substrate 10. Hence, each of the blocks 46A-46D requires an area having a reduced width of, for example, 1.5 mm for the 75 display signal lines. Each of the analog switch units 66 has 600 analog switches, which are corrected to corresponding data bus lines of a 75-bit data bus so that a plurality of analog switches are connected to one display signal line.

Figure 5:
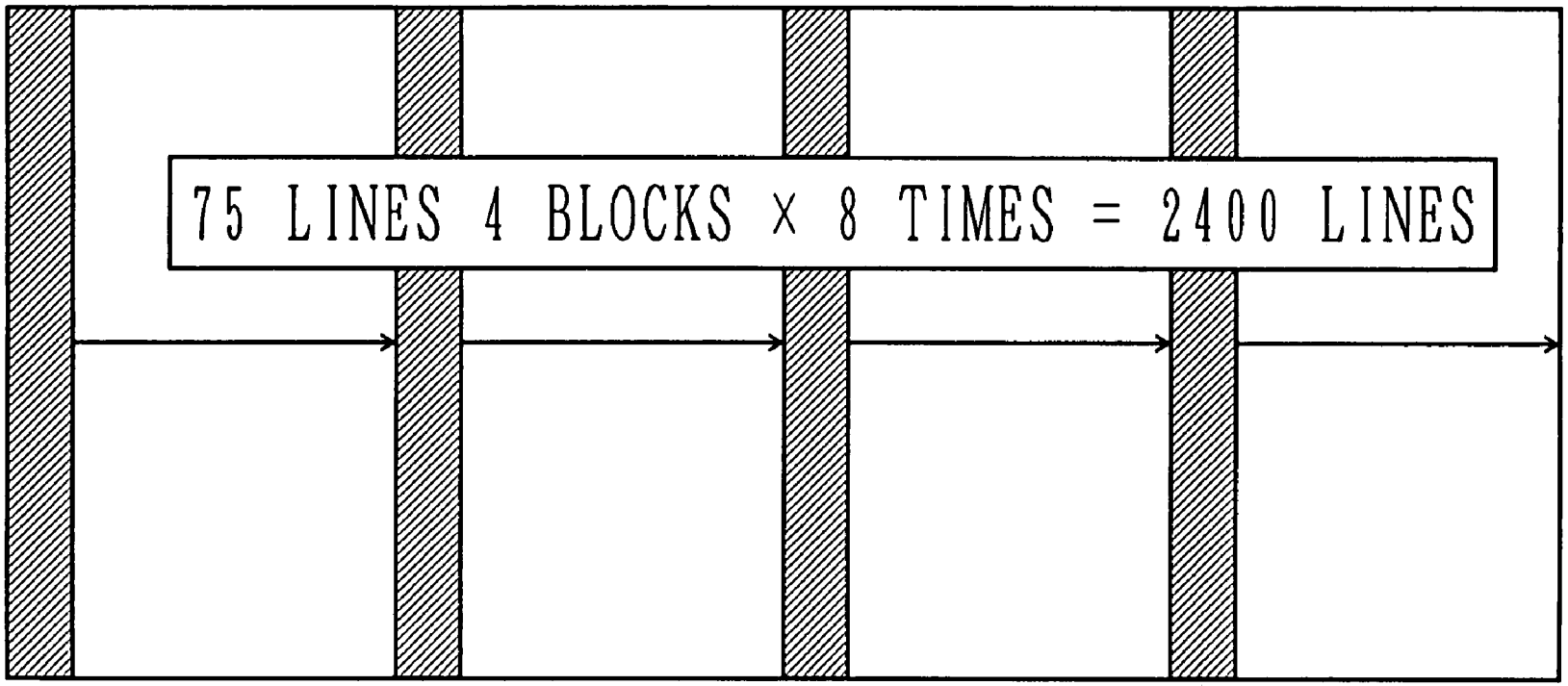
FIG. 5 shows a method of writing display signals in the device shown in FIG. 4.

FIG. 5 shows a method of writing display signals (D1-D75) 62 into the display panel 16. The blocks 46A-46D simultaneously receive the respective display signals having display signals D1-D75, and simultaneously perform the write operation thereon. In each of the blocks 46A-46D, the display signals D0—data D75 are simultaneously written into the 75 signal lines at once. The panel 16 has 2400 data bus lines, and thus each of the blocks 46A-46D is connected to respective 600 data bus lines. Hence, the write operation is repeated eight times in each of the blocks 46A-46D. That is, the number of write times in the present invention is one fourth of that of the prior art.

Figure 6:
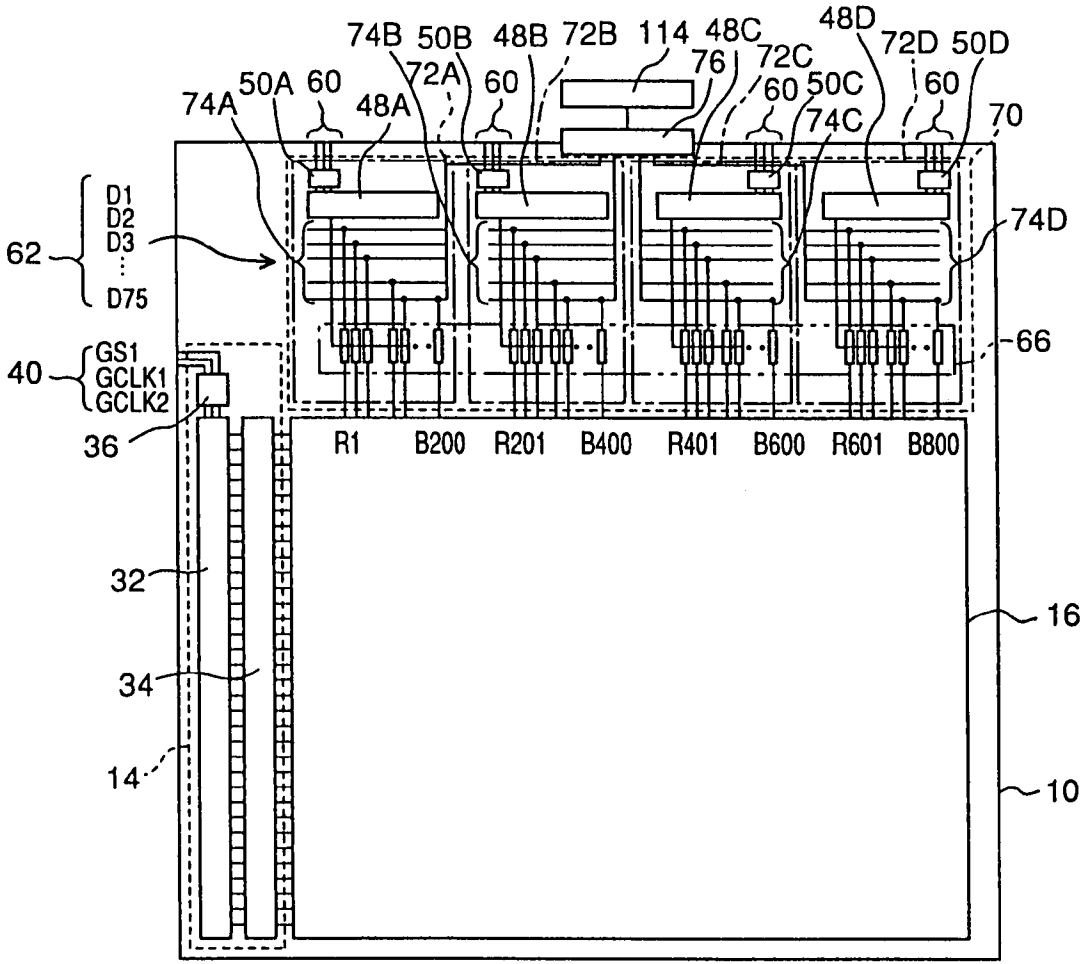
FIG. 6 is a block diagram of a liquid crystal display device according to a first embodiment of the present invention.

A description will now be given of a first embodiment of the present invention with reference to FIG. 6, in which parts that are the same as those shown in the previously described figures are given the same reference numbers. The display signal 62 is supplied from a driver IC device 76, which is called a TAB(Tape Automated Bonding) IC device.

A data driver 70 includes four blocks 72A-72D, which respectively have shift registers 48A-48D, level shifter 50A-50D, groups 75A-75D of display signal lines extending from the driver IC device 76, and the analog switch units 66 each having 600 analog switches. The driver IC device 76 is supplied with a display signal supplied from a display signal supply device 114, which will be described in detail with reference to FIGS. 11 and 12.

Figure 7:
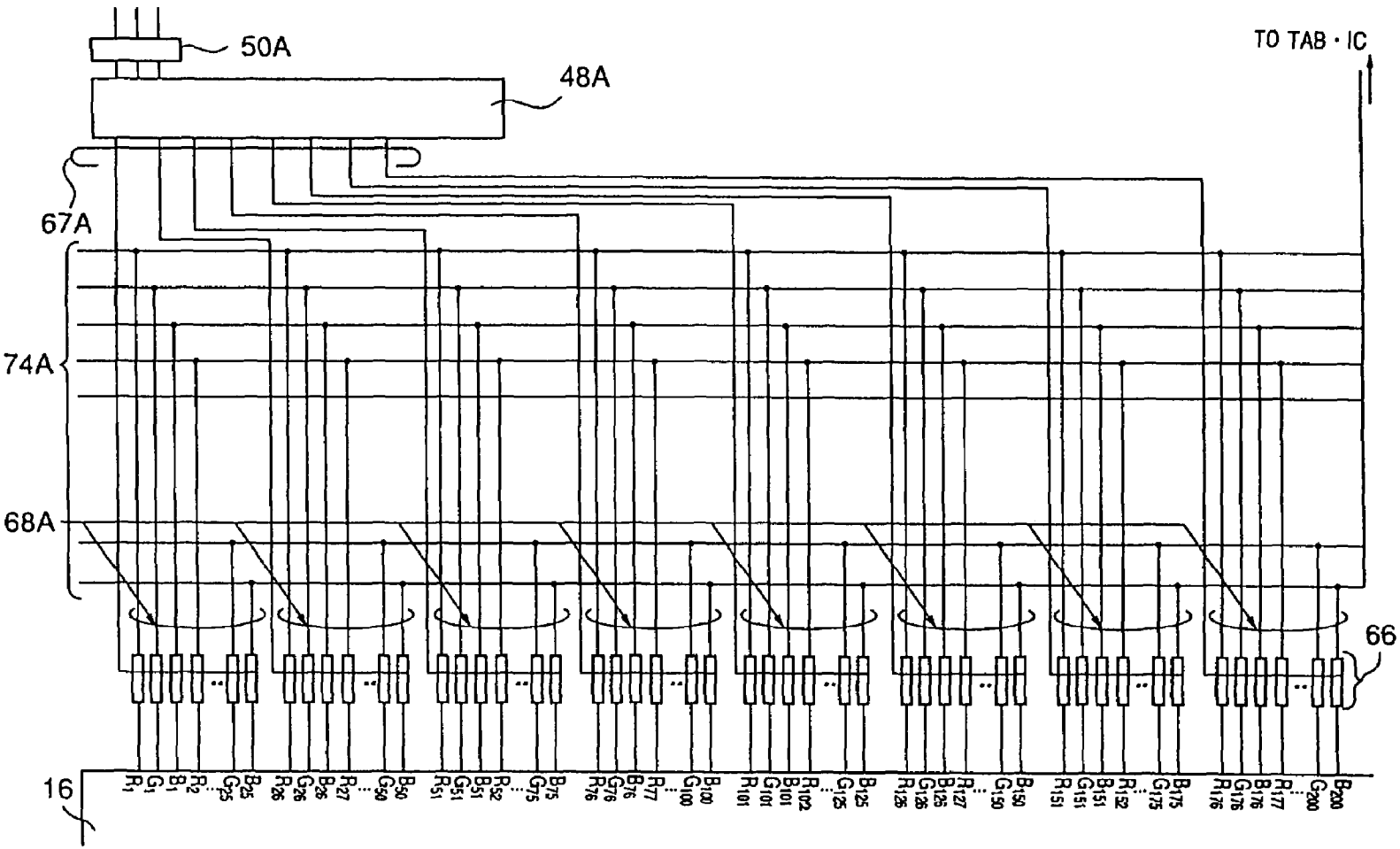
FIG. 7 is a diagram of a block 72A shown in FIG. 6.

FIG. 7 shows a structure of the block 72A. The display signals D1-D75 are supplied to the display signal lines 74A from the corresponding output terminals of the driver IC device 76. The start signal DS1 and the clock signals DCLK1 and DCLK2 are applied to the shift register 48A via a level shifter 50A of the block 72A. These control signals are commonly applied to the other blocks 72B-72D. Then, the shift register 48A operates a shift operation. The 75 analog switches of the analog switch unit 66 associated with input terminals R1-B25 of the panel 16 are simultaneously turned on, and the display signals D1-D75 are supplied to the panel 16 over a 75-bit data bus 68A via the analog switches. At this time, each of the other blocks 72B, 72C and 72D is supplied with the respective display signal having signals D1-D75. Further, the first 75 analog switches in each of the blocks 72B-72D are turned on by the respective shift registers 48B, 48C and 48D. Thus, the display signals D1-D75 in each of the blocks 72B, 72C and 72D are simultaneously written into the panel 16. Hence, 300 bits of display data are simultaneously written into the panel 16. During the above write operation, the first scanning line is driven by the shift register 32 via the buffer 34.

Then, the next display signals D1-D75 are supplied to the blocks 72A-72D, while the shift registers 48A-48D shifts the start pulses applied thereto by one step. Hence, the next 75 analog switches are selected in each of the blocks 72A-72D, and the display signals D1-D75 are written into the panel simultaneously.

The above operation is repeated eight times so that the 2400 bits of the display signal are written into the pixels of the panel 16 related to the first scanning line.

Figure 8:
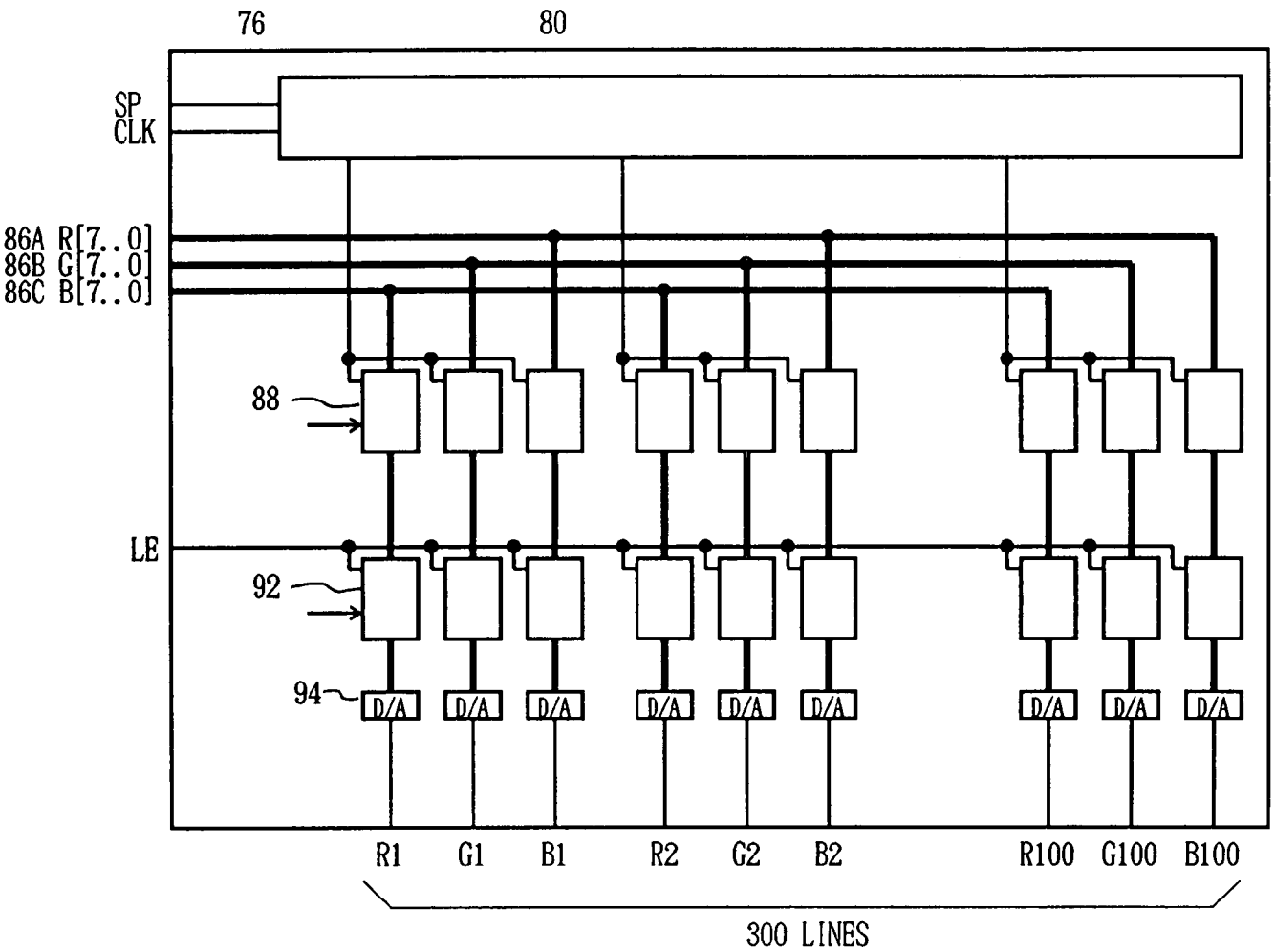
FIG. 8 is a block diagram of a driver IC device shown in FIG. 6.

FIG. 8 is a block diagram of the driver IC device 76. As shown in FIG. 8, the driver IC device 76 includes a shift register 80, eight-bit digital latch circuits 88, eight-bit digital latch circuits 92, and D/A (Digital-to-Analog) converters 94. The shift register 80 shifts a start pulse SP in synchronism with a clock signal CLK. Each of pulse signals by shifting the start pulse is applied to a respective group of three eight-bit digital latch circuits 88.

Eight-bit signals 86A, 86B and 86C are applied to the respective eight-bit digital latch circuits of the same group from the display signal supply device 114. The signal 86A consists of eight bits of display data R. The signal 86B consists of eight bits of display data B. The signal 86C consists of eight bits of display data C. The three latch circuits 88 of the same group are supplied with the shift pulse from the shift register 80 and simultaneously latch the eight-bit signals 86A-86C, respectively. Then, the next three latch circuits 88 of the same group are supplied with the shift pulse from the shift register 80 and simultaneously the eight-bit signals 86A-86C, respectively. In the above manner, the digital eight-bit latch circuits 88 are sequentially selected. When all the 300 latch circuits 88 have latched the corresponding eight-bit digital signals, a latched enable signal LE is applied to the digital eight-bit latch circuits 92, which simultaneously latch the eight-bit display signals from the corresponding latch circuits 88.

Then, the digital eight-bit signals are output from the latch circuits 92 and are converted into analog signals by the D/A converters 94. Hence, 300 display signals R1-B100 are output from the driver IC derive 76. The first, second, third and fourth 75 display signals are respectively supplied, as the display signals D1-D75, to the shift registers 48A, 48B, 48C and 48D of the blocks 72A, 72B, 72C and 72D.

Figure 9:
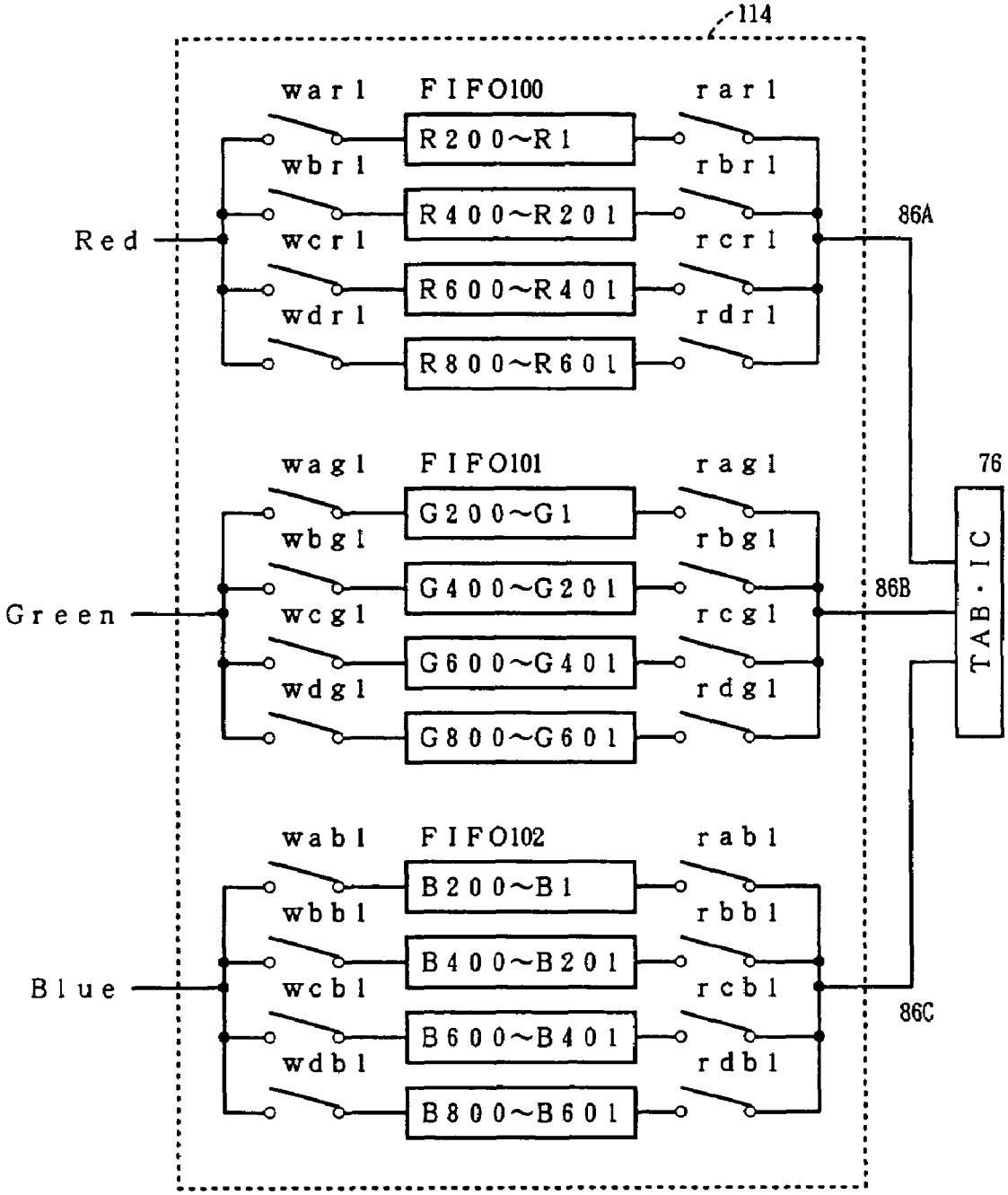
FIG. 9 is a block diagram of a display signal supply device used in the first embodiment of the present invention.

FIG. 9 shows a structure of the display signal supply device 114. With regard to a red signal externally supplied, the display signal supply device 114 includes input switches war1, wbr1, wcr1 and wdr1, a group 100 of four FIFO memories, and output switches rar1, rbr1, rcr1 and rdr1. The output terminals of the switches are connected together, via which the display signal 86A is output. With regard to a green signal externally supplied, the display signal supply device 114 includes input switches wag1, wbg1, wcg1 and wdg1, a group 101 of four FIFO memories, and output switches rag1, rbg1, rcg1 and rdg1. The output terminals of the switches are connected together, and the display signal 86B is output via these terminals. With regard to a blue signal supplied, the display signal supply device 114 includes input switches wab1, wbb1, wcb1 and wdb1, a group 102 of FIFO memories, and output switches rab1, rbb1, rcb1 and rdb1. The output terminals of the switches are connected together, and the display signal 86C is output via these output terminals.

The group 100 of FIFO memories handles 800 bits R1-R800 of the read signal. Similarly, the group 101 of FIFO memories handles 800 bits G1-G800 of the green signal, and the group 102 of FIFO memories handles 800 bits B1-B800 of the blue signal. Each of the group 100 of FIFO memories has 200 bits. That is, the four FIFO memories of the group 100 handle R1-R200, R201-R400, R401-R600 and R601-R800. The other groups 101 and 102 are configured in the same manner as the group 100.

Figure 10:
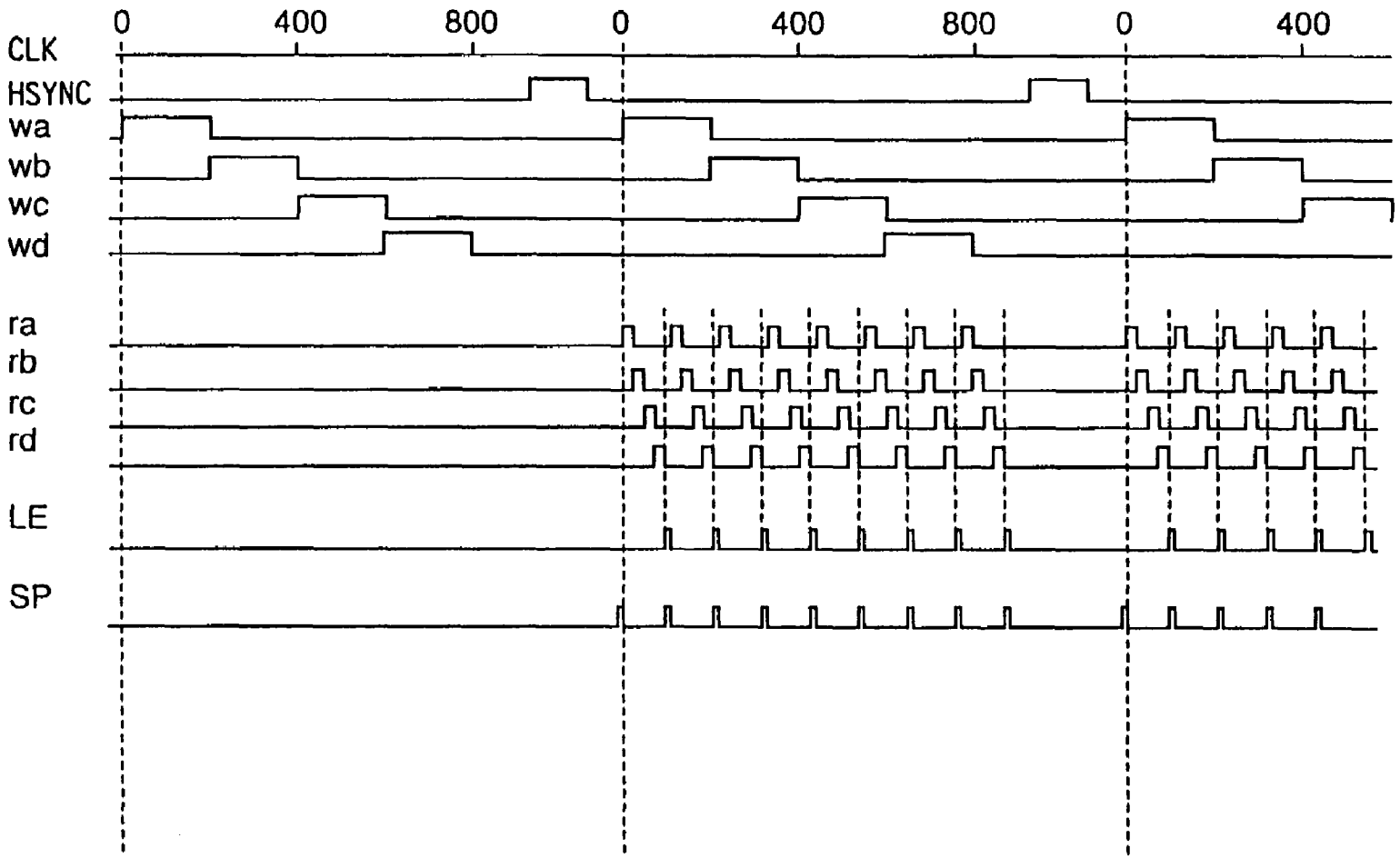
FIG. 10 is a timing chart of an operation of the display signal supply device shown in FIG. 9 and an operation of the driver IC device shown in FIG. 6.

FIG. 10 is a timing chart of an operation of the display signal supply device 114. Display data equal to one horizontal period is divided into four blocks. Since one horizontal period includes 800 pixels, display data are written into the groups of FIFO memories every 200 bits. A horizontal synchronizing signal HSYNC applied to the display signal supply device 114 resets all the FIFO memories shown in FIG. 9, which operate in synchronism with the clock signal CLK externally supplied thereto.

A select signal wa having a period equal to 200 pixels or bits is applied to the switches war1, wag1 and wab1 of the groups 100, 101 and 102. Hence, display data R0-R200, G1-G200 and B1-B200 are respectively written into the first FIFO memories of the groups 100, 101 and 102. Next, a select signal wb having a period equal to 200 bits is applied to the switches wbr1, wbg1 and wbb1. Hence, display data R201-R400, G201-G400 and B201-B400 are respectively written into the second FIFO memories of the groups 100, 101 and 102. Then, a select signal wc having a period equal to 200 bits is applied to the switches wcr1, wcg1 and wcb1. Hence, display data R401-R600, G401-G600 and B401-B600 are respectively written into the third FIFO memories of the groups 100, 101 and 102. Finally, a select signal wd having a period equal to 200 bits is applied to the switches wdr1, wdg1 and wdb1. Hence, display data R601-R800, G601-G800 and B601-B800 are respectively written into the fourth FIFO memories of the groups 100, 101 and 102.

The display data R0-R800, G0-G800 and B0-B800 are read from the FIFO memories via the output switches controlled by select signals ra, rb, rc and rd which are serially activated at different timings in this order. The first select signal ra is activated in response to the start pulse SP. The select signal ra having a period equal to 25 bits is applied to the output switches rar1, rag1 and rab1 twice while the select signal wa equal to 200 bits is active. Similarly, each of the select signals wb, wc and wd is applied to the corresponding output switches twice during the period of the select signal wa.

For example, each time the select signal ra is applied to the output switches rar1, rag1 and rab1, 25 bits of the red signal, 25 bits of the green signal, and 25 bits of the blue signal are output to the driver IC device 76 from the groups 100, 101 and 102. These 25-bit red, green and blue signals are the signals stored in the FIFO memories in the previous cycle.

Similarly, the select signals rb, rc and rd are serially applied and corresponding red, green and blue signals are read from the FIFO memories. Hence, when the select signals ra, rb, rc and rd are respectively applied once, 300 bits of display data are supplied to the driver IC device 76, and are written into the digital eight-bit latch circuits 88 shown in FIG. 8.

After the select signal rd is applied, the latch enable signal LE is activated, and the 300 bits of display data latched in the circuit 88 are latched in the digital eight-bit latch circuits 92 shown in FIG. 8. When the latch enable signal LE is high and active, all the output select signals ra-rd are low and are thus inactive. This is intended to satisfy that the general driver IC device 76 is required to inhibit the device 76 from latching next data for a given time equal to, for example, 5 clocks while the previous data is output.

Figure 11:
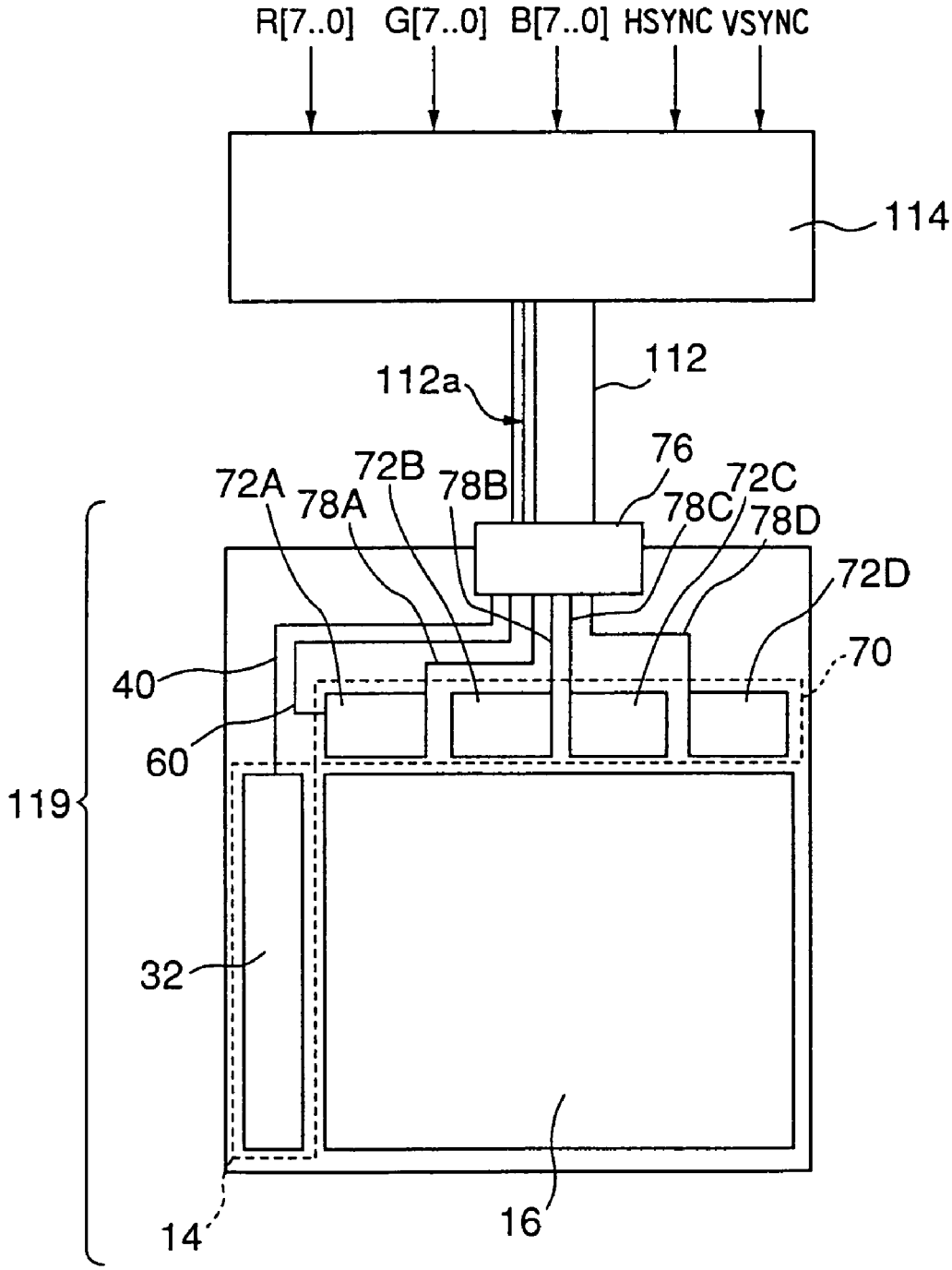
FIG. 11 is a diagram of an overall structure of the liquid crystal display device.

As shown in FIG. 11, the driver IC device 76 and the display signal supply device 114 are connected by a flexible cable 112 having a plurality of interconnection lines 112*a*. A reference number 119 indicates the liquid crystal display device, which is supplied with a vertical synchronizing signal VSYNC in addition to the aforementioned digital display signals R, G and B and the horizontal synchronizing signal HSYNC.

Figure 12:
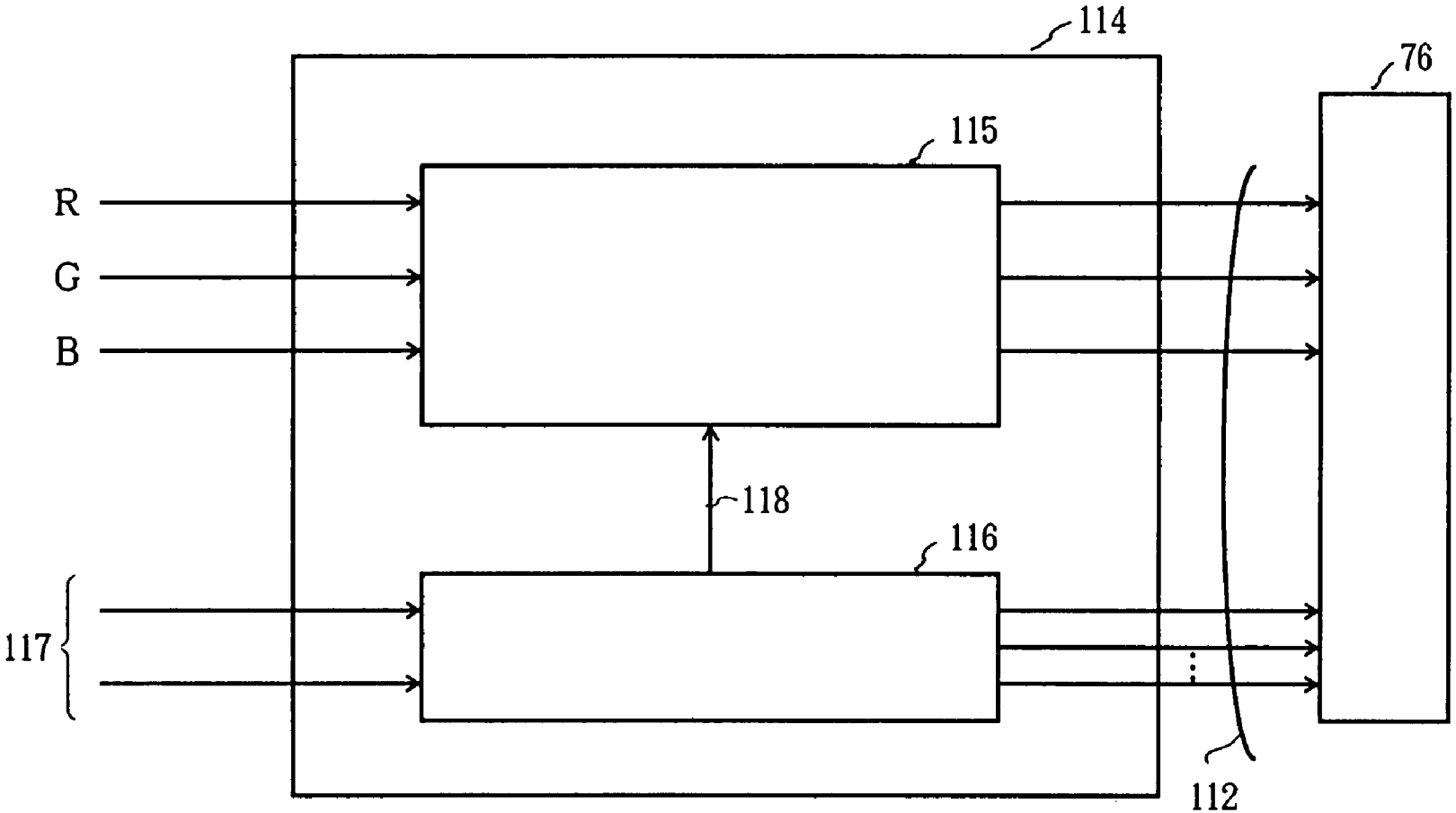
FIG. 12 is a block diagram of a structure of the display signal supply device shown in FIG. 12.

FIG. 12 is a block diagram of the display signal supply device 114. As shown in FIG. 12, the display signal supply device 114 includes a display signal supply circuit 115 and a timing circuit 116. The timing circuit 116 generates, from the horizontal and vertical synchronizing signals 117 externally supplied, the select signals applied to the input and output switches of the circuit 115 shown in FIG. 9, the start signals SP, DS1 and GS1, and the clock signals CLK, DCLK1, DCLK2, GCLK1 and GCLK2, and the latch enable signal LE. These signals are transferred to the driver IC device 76 via the flexible cable 112.

Figure 13:
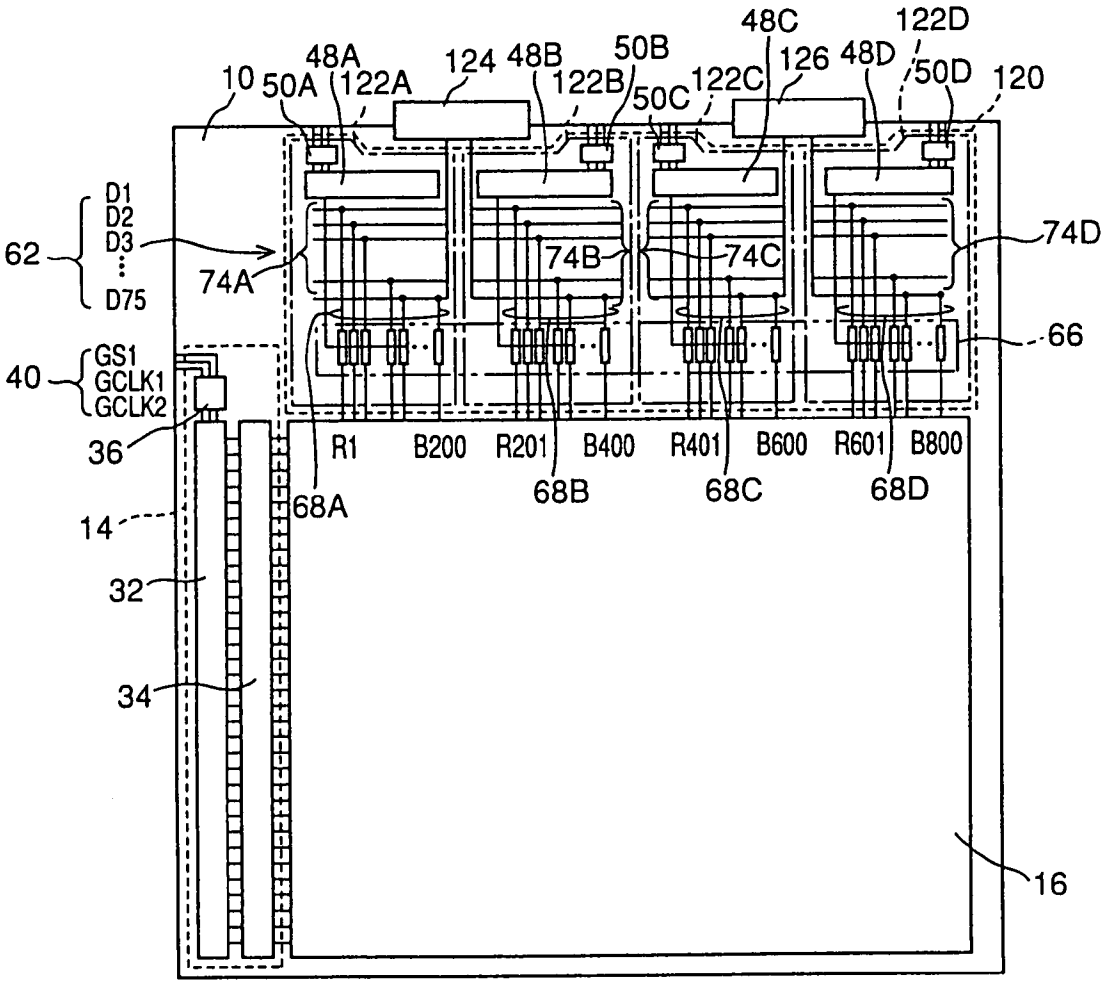
FIG. 13 is a block diagram of a liquid crystal display device according to a second embodiment of the present invention.

FIG. 13 is a block diagram of a liquid crystal display device according to a second embodiment of the present invention. In FIG. 13, parts that are the same as those shown in the previously described figures are given the same reference numbers. The liquid crystal display device shown in FIG. 13 employs two driver IC devices 124 and 126.

The data driver of the device shown in FIG. 13 is divided into four blocks 122A-122D, as in the case of the first embodiment of the present invention. The four blocks 122A-122D are the same as the four blocks 72A-72D shown in FIG. 6 although the positions of some circuits are different from those shown in FIG. 6.

The driver IC device 124 is supplied with display data equal to two blocks from a display data supply device 114A (which will be described later), and the driver IC device 126 is supplied with display data equal to two blocks therefrom. The driver IC device 124 supplies the display signals D1-D75 to the display signal lines 74A and the display signals D1-D75 to the display signal lines 74B. Similarly, the driver IC device 126 supplies display signals D1-D75 to the display signal lines 74C and the display signals D1-D75 to the display signal lines 74D. Then, the blocks 122A-122D operate in the same manner as the blocks 72A-72D.

Figure 14:
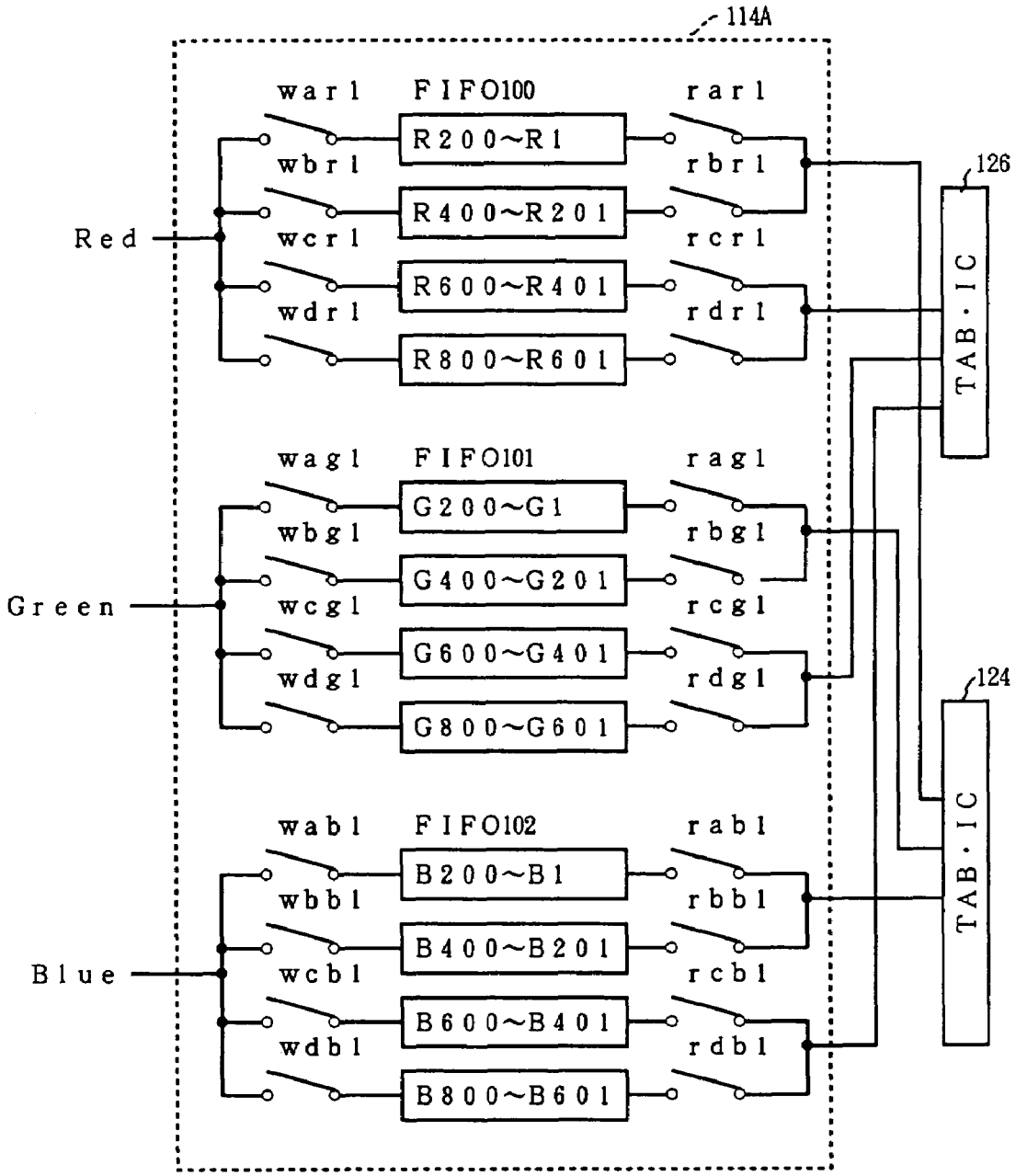
FIG. 14 is a block diagram of a display signal supply device used in the second embodiment of the present invention.

FIG. 14 is a block diagram of the display data supply circuit 114A to which the two driver IC devices 124 and 126 are connected. The display data supply circuit 114A has the same input and output switches and the FIFO memories as those of the circuit 114. However, the output terminals of the output switches are connected in a different manner as that of those in the circuit 114. More particularly, the output terminals of the output switches rar1 and rbr1 are connected together and to the driver IC device 124, and the output terminals of the output switches rcr1 and rdr1 are connected together and to the driver IC device 126. The output terminals of the output switches rag1 and rbg1 are connected together and to the driver IC device 124, and the output terminals of the output switches rcg1 and rdg1 are connected together and to the driver IC device 126. The output terminals of the output switches rab1 and rbb1 are connected together and to the driver IC device 124. The output terminals of the output switches rcb1 and rdb1 are connected together and to the driver IC device 126.

Figure 15:
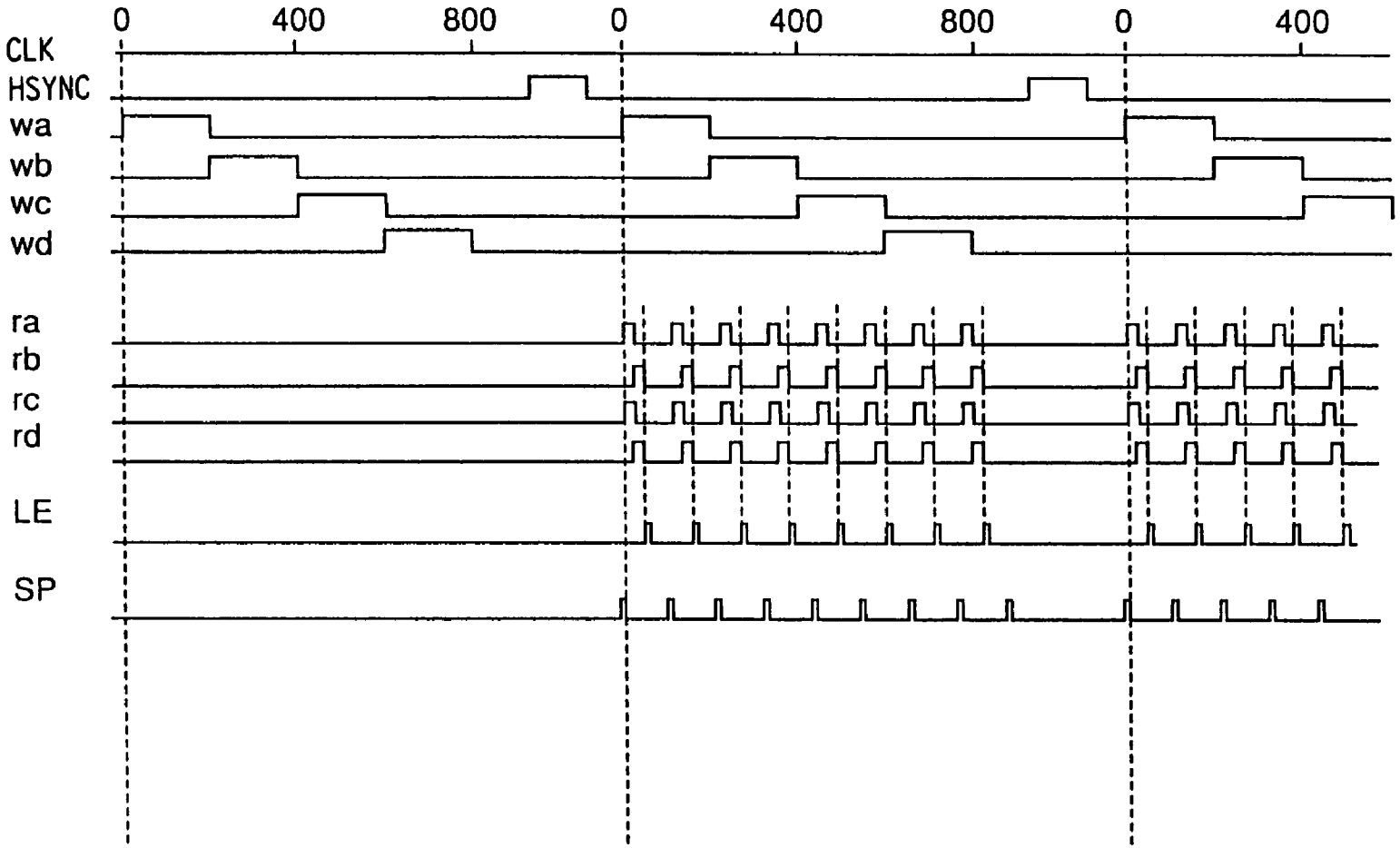
FIG. 15 is a timing chart of an operation of the display signal supply device shown in FIG. 14.

FIG. 15 is a timing chart of an operation of the display signal supply device 114A shown in FIG. 14. As shown in FIG. 15, the input switches war1, wbr1, wcr1 and wdr1, wag1, wbg1, wcg1 and wdg1, and wab1, wbb1, wcb1 and wdb1 are controlled in the same manner as those of the display signal supply device 114. In contrast, the output switches of the device 114A are controlled in a way different from that for the output switches of the device 114. More particularly, the select signals ra and rc are simultaneously activated and are applied to the corresponding output switches. Hence, R1-R25, G1-G25 and B1-B25 are supplied to the driver IC device 124, and simultaneously R401-R425, G401-G425 and B401-B425 are supplied to the driver IC device 126. Then, the select signals rb and rd are simultaneously activated and are applied to the corresponding output switches. Hence, R201-R225, G201-G225 and B201-B225 are supplied to the driver IC device 124, and simultaneously R601-R625, G601-G625 and B601-B625 are supplied to the driver IC device 126. Then, the latch enable signal LE is activated, so that R1-R25, G1-G25 and B1-B25 and R201-R225, G201-G225 and B201-B225 are output from the driver IC device 124, and simultaneously R401-R425, G401-G425 and B401-B425 are output from the driver IC device 126. That is, the 300 display signals in total are applied to the panel 16.

The above-mentioned operation is repeated eight times as shown in FIG. 15, so that the 2400 display signals (300×8) are supplied to the panel during one horizontal period and are displayed.

In FIG. 13, the display signal lines 74A and 74B extend from the driver IC device 124 straight and pass through an interface area between the adjacent blocks 122A and 122B. Similarly, the display signal lines 74C and 74D extend from the driver IC device 126 straight and pass through an interface area between the adjacent blocks 122C and 122D. Hence, as compared to the arrangement shown in FIG. 6, the area for routing and arranging the display signal lines can be reduced by, for example, 1.5 mm. In addition, the lengths of the display signal lines extending from the driver IC device can be reduced.

Figure 16:
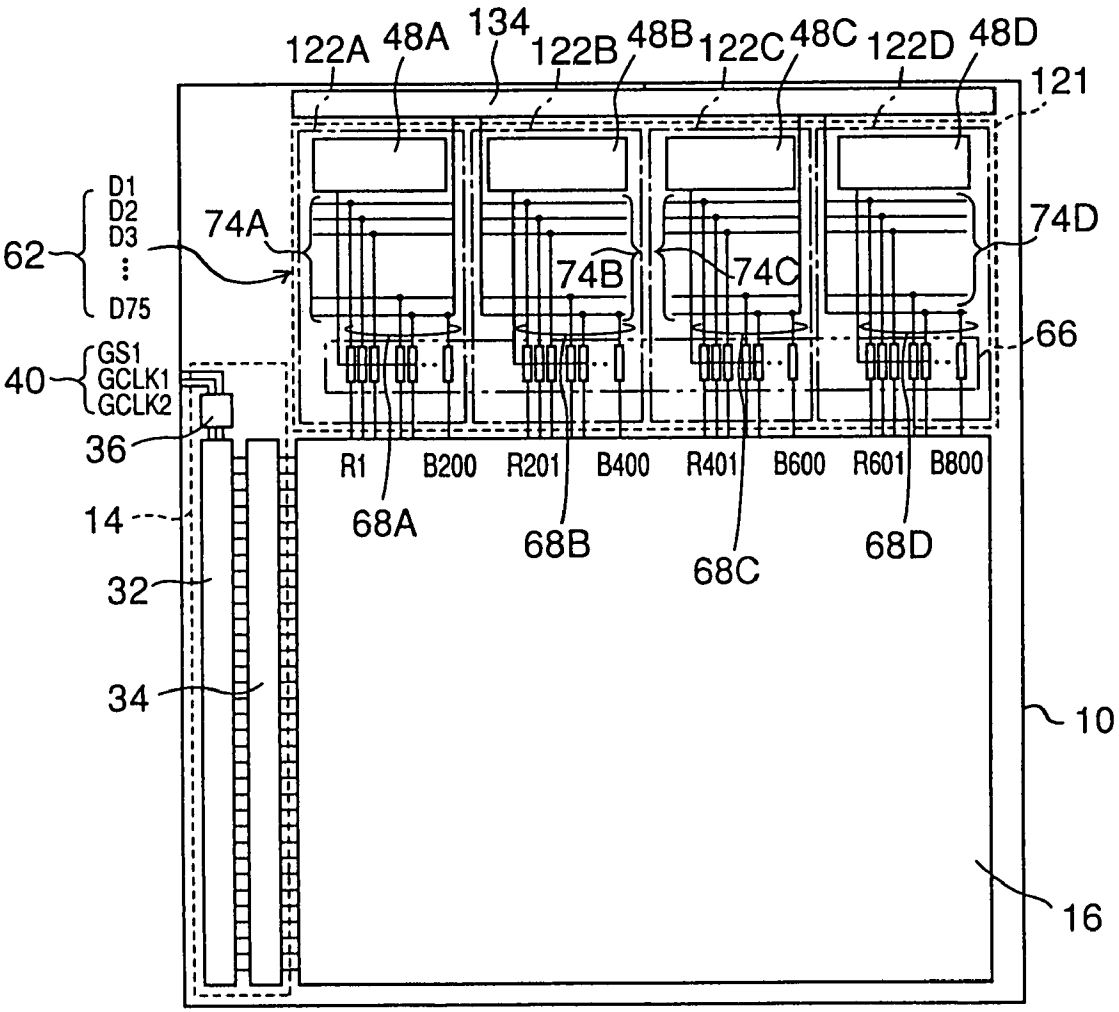
FIG. 16 is a block diagram of a liquid crystal display device according to a third embodiment of the present invention.

FIG. 16 shows a liquid crystal display device according to a third embodiment of the present invention, in which parts that are the same as those in the previously described figures are given the same reference numbers. The device shown in FIG. 16 does not use any driver IC devices but uses an on-panel digital driver 134 that is formed on the panel 16.

The device shown in FIG. 16 has a data driver 121, which is divided into four blocks 122A-122D, which are connected to the on-panel digital driver 134. The digital driver 134 corresponds to the combination of the driver IC devices 124 and 126. That is, the digital driver 134 operates as shown in FIG. 15.

According to the third embodiment of the present invention, the peripheral circuits of the panel 16 including the on-panel digital driver 134 are formed on the panel, so that the number of connecting points can be reduced and down sizing of the device can be facilitated.

Figure 17:
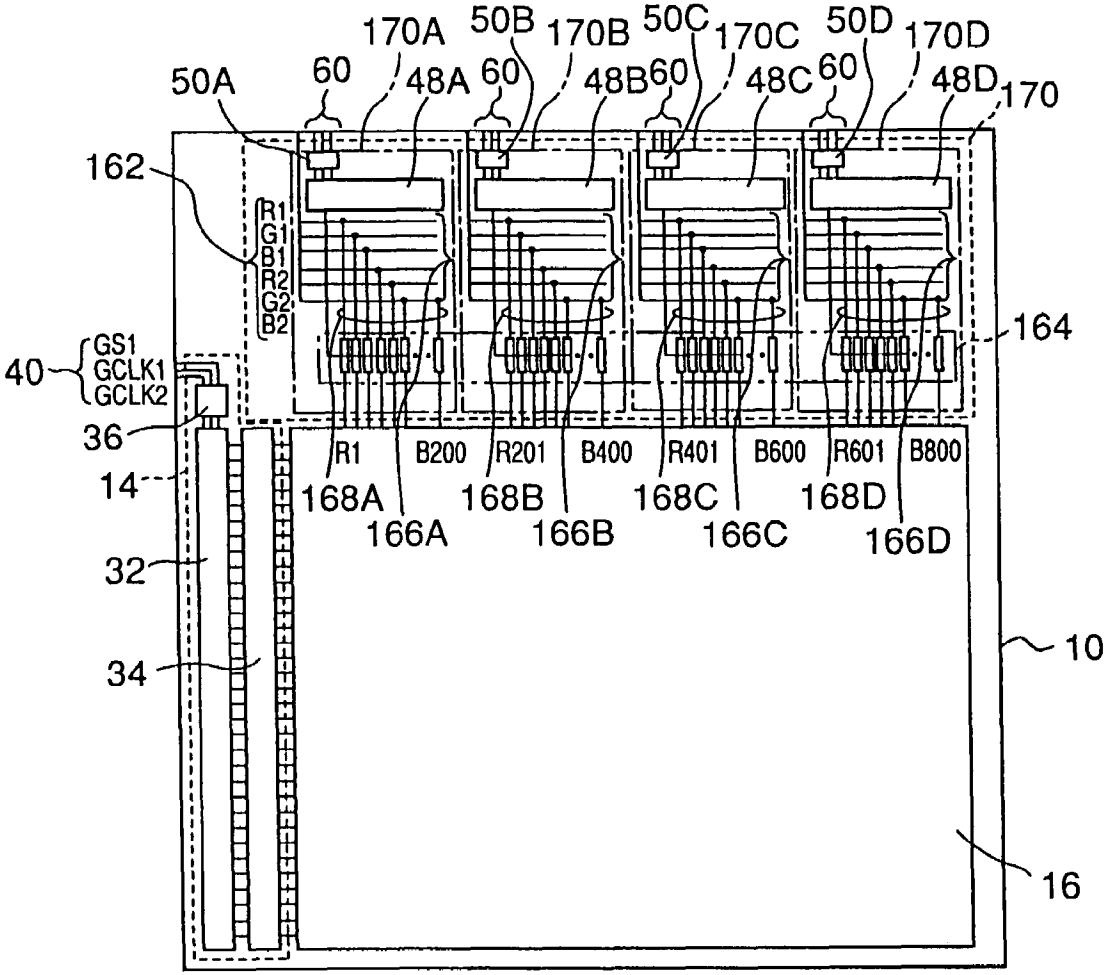
FIG. 17 is a block diagram of a liquid crystal display device according to a fourth embodiment of the present invention.

FIG. 17 shows a liquid crystal display 662 device according to a fourth embodiment of the present invention, which has four blocks 170A-170D, which have six display signal lines 166A, 166B, 166C and 166D. In FIG. 17, parts that are the same as those shown in the previously described figures are given the same reference numbers.

The blocks 170A-170D respectively have shift registers 48A-48D, the level shifters 50A 50D, the display signal lines 166A-166D and the analog switches 164, which switches are connected to the display panel 16. The shift registers 48A-48B can be supplied with the display signals from one or a plurality of driver IC devices or the on-panel digital driver. The first through third embodiments of the present invention have the display signal lines provided to the respective display signals. In contrast, according to the fourth embodiment of the present invention, each of the six display signal lines is shared by a plurality of display signals in order to reduce the number of display signal lines.

In operation, 24 pieces of display data (6 display digital lines×4 blocks) are supplied to the driver IC device or the on-panel digital driver. For example, display data directed to the block 170A are "R1G1B1R2G2B2". Then, in response to the latch enable signal LE (an illustration thereof is omitted in FIG. 17), every six ones of the 24 display signals 162 are simultaneously supplied to the respective one of the display signal lines 166A-166D of the respective blocks 170A-170D. For example, the six display signal lines 166A of the block 170A are supplied with the display signals R1, G1, B1, R2, G2, and B2. Then, the first six analog switches 164 are turned on, and the above display signals are supplied to the panel 16.

Similarly, every six one of the next 24 display signals subsequent to the first 24 display signals are supplied from the driver IC device or the on-panel digital driver to the respective one of the display signal lines 166A-166D. For example, the six display lines 166A of the block 170A are supplied with the display signals R3, G3, B3, R4, G4 and B4. In this manner, the 100 display signals are written onto one display line in each of the blocks 170A-170D. Hence, the blocks 170A-170D operate in synchronism with each other, and the 600 display signals are supplied to the panel in each of the blocks 170A-170D. Thus, the shift registers 48A-48D can commonly use the start pulse DS1 and the clock signals DCLK1 and DCLK2.

The fourth embodiment of the present invention uses only six display signal lines, and can be miniaturized. For example, the width of an area for accommodating the six display signal lines 166A can be reduced to approximately 0.6 mm.

Figure 18:
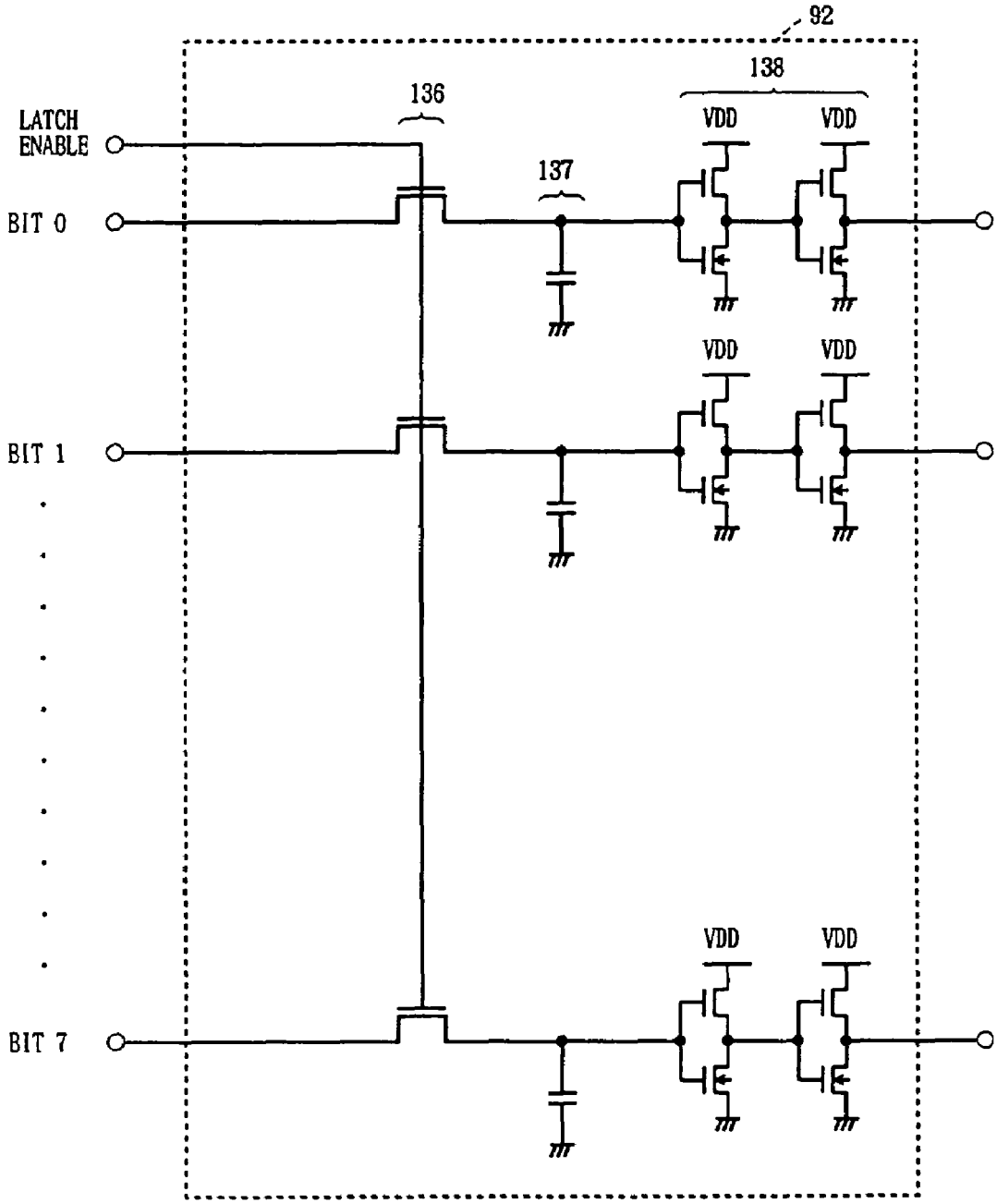
FIG. 18 is a circuit diagram of a digital eight-bit latch circuit shown in FIG. 8.

FIG. 18 is a circuit diagram of one of the eight-bit latch circuits 92 used in the configuration shown in FIG. 8. The eight-bit latch circuits 88 also used in the configuration shown in FIG. 8 are configured in the same manner as the circuits 92. The eight-bit latch circuit shown in FIG. 18 includes gate switches 136, capacitors 137, and two-stage inverter circuits 138. The gates of the gate switches 136 are supplied with the latch enable signal LE. Each of the capacitors 137 is charged when the corresponding input signal is high and the corresponding gate switch 136 is ON. The inverters 138 of the first stage are controlled by the states of the corresponding capacitors 137. Hence, a power supply voltage VDD or ground voltage is output via the respective output terminals of the eight-bit latch circuit 92 in accordance with the corresponding input signals. In the eight-bit latch circuits 88, the latch enable signal LE is supplied from the shift register 80 shown in FIG. 8.

Figure 19:
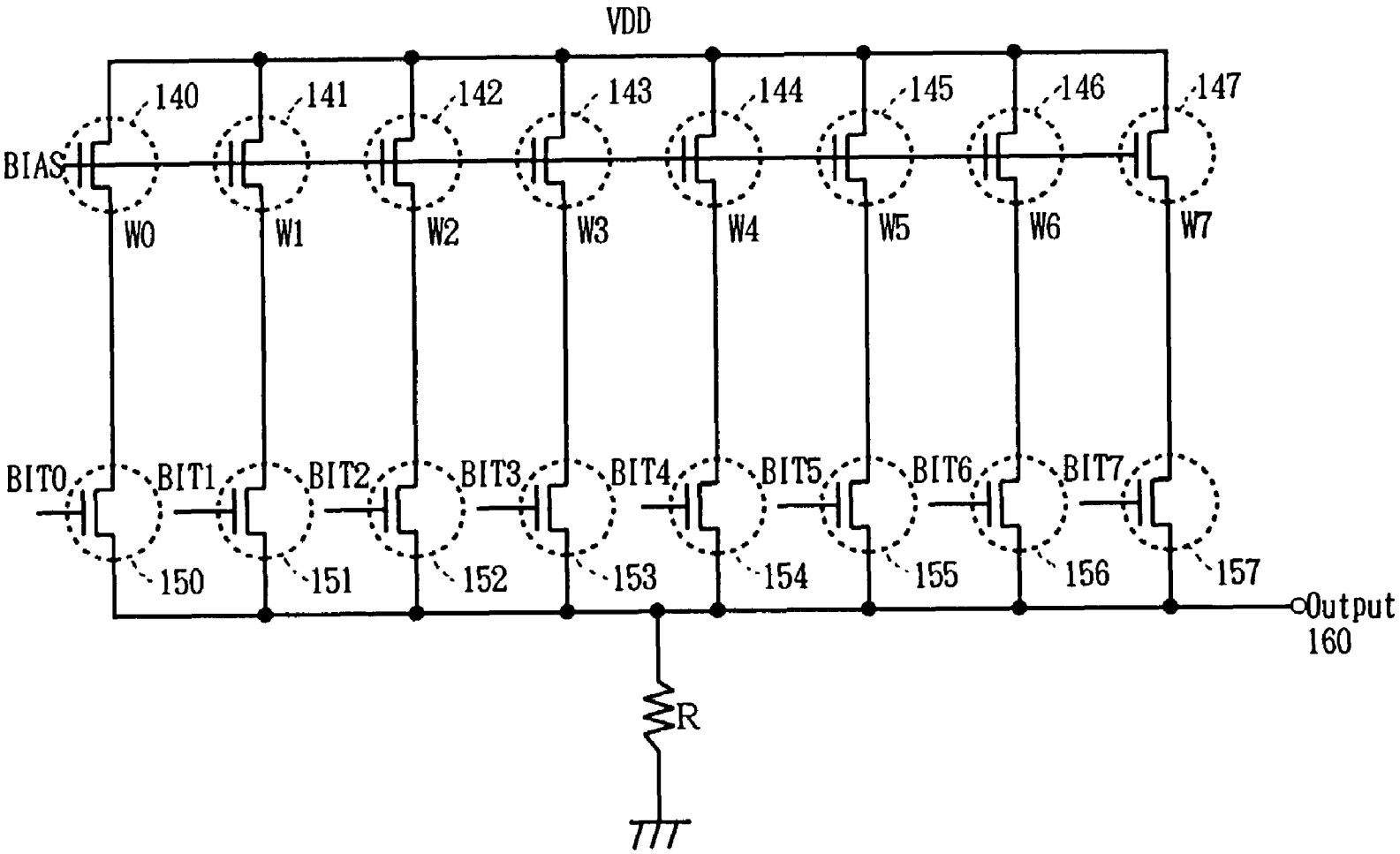
FIG. 19 is a circuit diagram of an eight-bit D/A converter shown in FIG. 8.

FIG. 19 is a circuit diagram of each of the D/A converters 94, which converts the eight-bit digital signal into a corresponding analog signal. The DIA converter 94 includes transistors 140-147 which implement resistors of different resistance values, and gate transistors 150-157. The transistors 140-147 have different channel widths W0-W7, which realize the different resistance values. For example, the channel width W0 is the shortest, and the channel width W7 is the longest. The drains of the transistors 140-147 are supplied with the power supply voltage VDD. The gates of the transistors 140-147 are supplied with a high-level bias signal, so that all the transistors 140-147 are ON. The sources of transistors 140-147 are connected to the drains of the transistors 150-157. The gates of the transistors 150-157 are supplied with the respective bits of the eight-bit digital input signal, and the sources thereof are grounded via a resistor R and are connected to an output terminal 160. The current flowing in the resistor R depends on which transistors are turned on in response to the eight-bit digital input signal. The voltage of the end of the resistor R1 depends on the magnitude of the current flowing in the resistor R.

Figure 20:
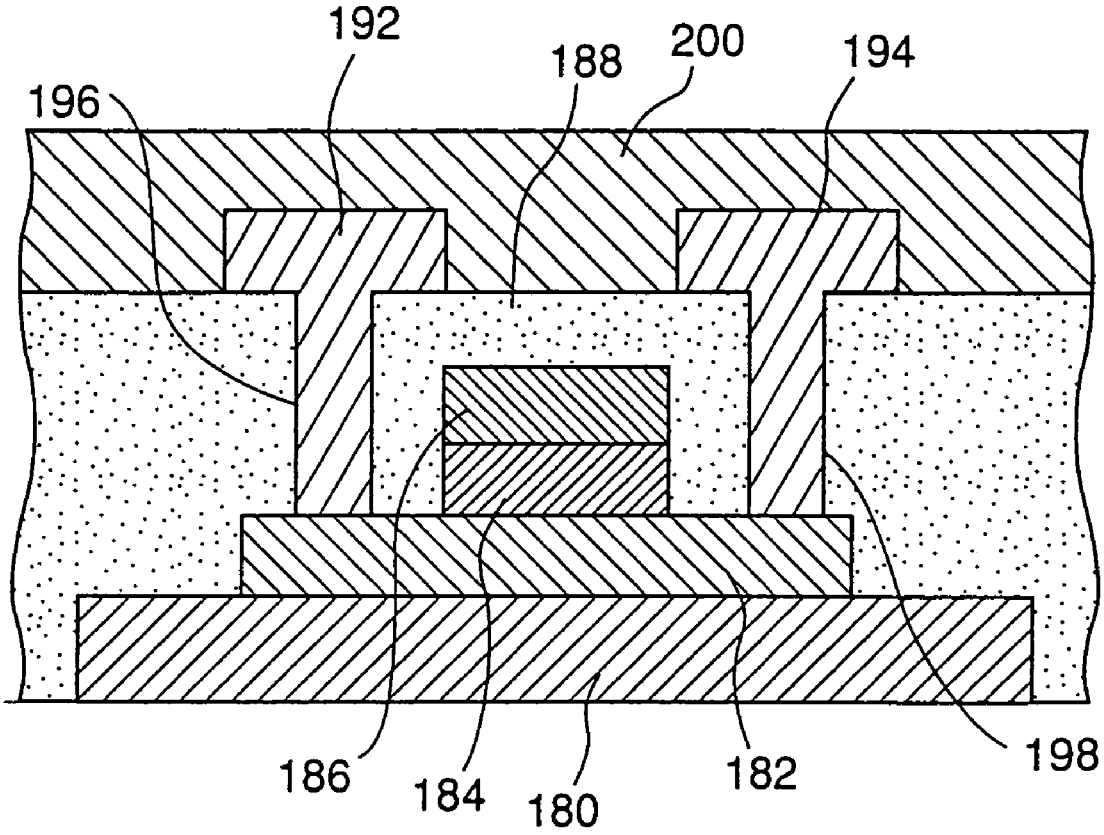
FIG. 20 is a cross-sectional view of a polysilicon transistor used to form a pixel on the liquid crystal display panel.

FIG. 20 is a cross-sectional view of the display panel 16 and shows one pixel formed thereon. A polysilicon layer 182 serving as an active layer is formed on a glass substrate 180. An $SiO_2$ layer 184 is formed on the polysilicon layer 182 as a gate insulating film. A polysilicon layer 186 is formed on the $SiO_2$ layer 184. An insulating layer 188 is provided by a reflow process, and contact holes 196 and 198 are formed in the insulating layer 188 by a photolithography and dry etching process. Then, polysilicon doped with phosphorus or the like is deposited and patterned into a source electrode 192 and a drain electrode 194. Then, an insulating film 200 is subjected to a reflow process so that a protection film is formed. A polysilicon transistor thus formed can be applied to all transistors formed on the panel 16. For example, the data drivers can be formed by polysilicon transistors.

The present invention is not limited to the specifically disclosed embodiments, and variations and modifications may be made without departing from the scope of the present invention.

What is claimed is:

1. A liquid crystal display device including a data driver and a gate driver, comprising:

a liquid crystal display panel having two opposing flat surfaces, an area of one of said flat surfaces for displaying an image, and at least two edges opposing one another about said flat surfaces and outside of said display area; and a substrate on which said liquid crystal display panel, and the data driver, and the gate driver are integrally formed, the data driver on a single edge of said at least two opposing edges of the liquid crystal display panel being divided into a plurality of blocks so as to divide the liquid crystal display panel into sections arranged side by side, which simultaneously supply the liquid crystal display panel with display signals respectively supplied thereto, wherein each of said blocks includes a plurality of signal lines that are connected to a plurality of data bus lines via analog switches, a number of said data bus lines included in each of said blocks being larger than a number of said signal lines included in each of said blocks, said display signals simultaneously being supplied from the plurality of signal lines to one of the plurality of blocks of the panel via the analog switches simultaneously with supplying of said display signals to subsequent ones of the plurality of blocks of the panel, and wherein said blocks are arranged adjacent to each other along the single edge of the liquid crystal display panel, and each block includes a series of different signal lines.

2. The liquid crystal display device as claimed in claim 1, wherein each of the blocks comprises:

a shift register;

signal lines to which the display signals are supplied;

data bus lines connected to the signal lines and the liquid crystal display panel; and analog switches provided in the data bus lines and controlled by an output signal of the shift register.

3. The liquid crystal display device as claimed in claim 1, further comprising a driver device which receives display data externally supplied and outputs the display signals derived therefrom to the blocks of the data driver.

4. The liquid crystal display device as claimed in claim 1, further comprising a plurality of driver devices which are respectively associated with a plurality of ones of the blocks, each of the plurality of driver devices receiving display data externally supplied and outputting the display signals derived therefrom to associated blocks of the data driver.

5. The liquid crystal display device as claimed in claim 4, wherein the display signal lines of the associated blocks have parts extending from one of the plurality of driver devices through a space located between the associated blocks.

6. The liquid crystal display device as claimed in claim 1, further comprising a substrate on which said liquid crystal display panel, said data driver, and said gate driver are integrally formed.

7. The liquid crystal display device as claimed in claim 1, wherein said data driver comprises polysilicon transistors.

8. The liquid crystal display device as claimed in claim 3, further comprising a display signal supply device which outputs the display data to the driver device.

9. The liquid crystal display device as claimed in claim 8, wherein the display signal display device is formed on the liquid crystal display panel.

10. The liquid crystal display device as claimed in claim 4, further comprising a display signal supply device which outputs the display data to the plurality of driver devices.

11. The liquid crystal display device as claimed in claim 1, wherein each of the plurality of blocks supplies the liquid crystal display panel with a given number of display signals at once.

12. The liquid crystal display device as claimed in claim 3, wherein said driver device comprises a shift register which outputs a shift signal, first latch circuits which latches the display data in response to the shift signal, and second latch circuits which latches the display data from the first latch circuits in response to a latch enable signal externally supplied.

13. The liquid crystal display device as claimed in claim 12, further comprising digital-to-analog converters which convert the display data from the second latch circuits into analog signals.

14. A liquid crystal display device including a data driver and a gate driver, comprising:

a liquid crystal display panel having two opposing flat surfaces, an area of one of said flat surfaces for displaying an image, and at least two edges opposing one another about said flat surfaces and outside of said display area; and groups of signal lines for carrying display signals, said signal lines within each of said groups being adjacent to each other along a single edge of said at least two opposing edges of said liquid crystal display panel, the data driver being divided into a plurality of adjacently arranged blocks from which said groups of signal lines extend over corresponding partial areas of the liquid crystal display device so that each of said groups of signal lines is associated with a respective one of said blocks of the data driver, wherein said signal lines in each of said blocks are connected to a plurality of data bus lines via analog switches, a number of said data bus lines included in each of said blocks is larger than a number of said signal lines included in each of said blocks, and the display signals are simultaneously supplied from the groups of signal lines to one of the plurality of blocks of the panel via the analog switches simultaneously with supplying of said display signals to subsequent ones of the plurality of blocks of the panel.

15. A liquid crystal display device including a data driver and a gate driver, comprising:

a liquid crystal display panel having two opposing flat surfaces, an area of one of said flat surfaces for displaying an image, and at least two edges opposing one another about said flat surfaces and outside of said display area; and signal lines extending from the data driver and carrying display signals, the data driver and the signal lines being divided into a plurality of blocks so that said divided signal lines extending from one of said plurality of blocks extend over a corresponding divided area of the liquid crystal display device, wherein said plurality of blocks are adjacent to each other along a single edge of said at least two opposing edges of said liquid crystal display panel, said divided signal lines in each of said plurality of blocks are connected to a plurality of data bus lines via analog switches, a number of said data bus lines included in each of said blocks being larger than a number of said signal lines included in each of said blocks, and display signals being simultaneously supplied from said signal lines to one of the plurality of blocks of the panel via the analog switches simultaneously with supplying of said display signals to subsequent ones of the plurality of blocks of the panel.

16. A liquid crystal display device including a data driver and a gate driver, comprising:

a liquid crystal display panel having two opposing flat surfaces, an area of one of said flat surfaces for displaying an image, and at least two edges opposing one another about said flat surfaces and outside of said display area; and a substrate on which said liquid crystal display panel, the data driver, and the gate driver are integrally formed, wherein the data driver is divided into a plurality of blocks arranged side by side along a single edge of said at least two opposing edges of the liquid crystal display panel, and each of said blocks has a plurality of signal lines that extend into the liquid crystal display device and are connected to a plurality of data bus lines via analog switches, a number of said data bus lines included in each of said blocks being larger than a number of said signal lines included in each of said blocks, and display signals being simultaneously supplied from said plurality of signal lines to one of the plurality of blocks of the panel via the analog switches simultaneously with supplying of said display signals to subsequent ones of the plurality of blocks of the panel.

17. The liquid crystal display device as claimed in claim 16, wherein said data driver comprises polysilicon transistors.

18. The liquid crystal display panel as claimed in claim 1, wherein said each of said blocks is arranged adjacent to a block of at least one of an immediately preceding block and an immediately following block.

19. The liquid crystal display panel as claimed in claim 14, wherein said each of said blocks is arranged adjacent to a block of at least one of an immediately preceding block and an immediately following block.

20. The liquid crystal display panel as claimed in claim 15, wherein said each of said blocks is arranged adjacent to a block of at least one of an immediately preceding block and an immediately following block.

21. The liquid crystal display panel as claimed in claim 16, wherein said each of said blocks is arranged adjacent to a block of at least one of an immediately preceding block and an immediately following block.

* * * * *